US012163396B2

(12) United States Patent
Painter et al.

(10) Patent No.: US 12,163,396 B2
(45) Date of Patent: Dec. 10, 2024

(54) SYSTEMS AND METHODS FOR INDEPENDENT CONTROL AND OPERATIONS OF TUBING AND ANNULUS AT THE WELLHEAD

(71) Applicant: Chevron U.S.A. Inc., San Ramon, CA (US)

(72) Inventors: Jay Patrick Painter, League City, TX (US); Kevin Frank Leo Hejl, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 17/971,319

(22) Filed: Oct. 21, 2022

(65) Prior Publication Data

US 2024/0133261 A1 Apr. 25, 2024
US 2024/0229589 A9 Jul. 11, 2024

(51) Int. Cl.
*E21B 33/04* (2006.01)
*E21B 33/072* (2006.01)

(52) U.S. Cl.
CPC ..... *E21B 33/04* (2013.01); *E21B 33/072* (2013.01)

(58) Field of Classification Search
CPC .... E21B 33/04; E21B 33/072; E21B 33/0353; E21B 33/03; E21B 34/02; E21B 43/122; E21B 43/123
See application file for complete search history.

(56) References Cited

U.S. PATENT DOCUMENTS 5,727,640 A * 3/1998 Gleditsch ..... E21B 33/063 175/7
2002/0000315 A1* 1/2002 Kent ..... F16K 3/0218 166/85.4
2002/0011336 A1* 1/2002 Baskett ..... E21B 34/02 166/88.4
2003/0006042 A1* 1/2003 DeBerry ..... E21B 33/035 166/368
2004/0200615 A1* 10/2004 Wilde ..... E21B 43/122 166/250.15
2016/0024878 A1* 1/2016 June ..... E21B 33/068 166/373
2018/0119513 A1* 5/2018 Vincent ..... E21B 47/12
2018/0266214 A1* 9/2018 Robinson ..... E21B 41/00

* cited by examiner

*Primary Examiner* — Tara Schimpf
*Assistant Examiner* — Jennifer A Railey
(74) *Attorney, Agent, or Firm* — Smith & Woldesenbet Law Group, PLLC

(57) ABSTRACT

A tubing spool of a wellhead assembly can include a body having a body cavity, a first channel, and a second channel disposed therein, where the body cavity is configured to receive a tubing hanger used to couple to and suspend a tubing string, where the first channel is configured to be in communication with a tubing string cavity within the tubing string, where the second channel is configured to be in communication with an annulus located between the tubing string and a production casing, and where the first channel and the second channel are each configured to facilitate flow of at least one of a plurality of fluids in either direction independently of each other. The tubing spool can also include a first back pressure valve disposed within the first channel and a second back pressure valve disposed within the second channel.

7 Claims, 8 Drawing Sheets

SYSTEMS AND METHODS FOR INDEPENDENT CONTROL AND OPERATIONS OF TUBING AND ANNULUS AT THE WELLHEAD

TECHNICAL FIELD

The present application is related to wellheads and, more particularly, to independent control and operations of the tubing and annulus at the wellhead.

BACKGROUND

In order to inject into and/or produce the tubing and/or the annulus between the tubing and casing, significant time and expense must be expended to transition to such operations. For example, after initial extraction (e.g., four months, six months) of subterranean resources through the production casing through a large bore tree at the surface, the well is killed, and workover equipment is brought in. After some dead time (e.g., a month), a blowout preventer is then added, and completion of the well runs. At this point a small tree is installed and newly fabricated facility connections are made. Also, current methods of production lack a back pressure valve (BPV) preparation to isolate the annulus production/injection flow path, which can present a safety hazard.

SUMMARY

In general, in one aspect, the disclosure relates to a tubing spool of a wellhead assembly that includes a body having a body cavity, a first channel, and a second channel disposed therein, where the body cavity is configured to receive a tubing hanger used to couple to and suspend a tubing string, where the first channel is configured to be in communication with a tubing string cavity within a tubing string, where the second channel is configured to be in communication with an annulus located between the tubing string and a production casing, and where the first channel and the second channel are each configured to facilitate flow of at least one of a plurality of fluids in either direction independently of each other. The tubing spool can also include a first back pressure valve disposed within the first channel to isolate the first channel. The tubing spool can further include a second back pressure valve disposed within the second channel to isolate the second channel.

In another aspect, the disclosure relates to a wellhead assembly that includes a plurality of flow control valves, where each of the plurality of flow control valves has a fully closed position and a fully open position, where the plurality of flow control valves includes a first flow control valve, a second flow control valve, a third flow control valve, and a fourth flow control valve. The wellhead assembly can also include piping coupled to the plurality of flow control valves. The wellhead assembly can further include a tubing hanger that is coupled to and suspends a tubing string. The wellhead assembly can also include a tubing spool that can include a body having a body cavity, a first channel, and a second channel disposed therein, where the tubing hanger is configured to be positioned within the body cavity of the body, where the first channel is in communication with a tubing string cavity within the tubing string, where the second channel is in communication with an annulus located between the tubing string and a production casing, where the first channel and the second channel are coupled to the piping, and where the first channel and the second channel are each configured to facilitate flow of at least one of a plurality of fluids in either direction independently of each other. The tubing spool can also include a first back pressure valve disposed within the first channel to isolate the first channel. The tubing spool can further include a second back pressure valve disposed within the second channel to isolate the second channel. The first flow control valve and the second flow control valve can control flow relative to the second channel, and the third flow control valve and the fourth flow control valve can control flow relative to the first channel.

In yet another aspect, the disclosure relates to a method for operating a wellhead assembly. The method can include installing the wellhead assembly at a wellbore, where the wellhead assembly can include a plurality of flow control valves, where each of the plurality of flow control valves has a fully closed position and a fully open position, where the plurality of flow control valves comprises a first flow control valve, a second flow control valve, a third flow control valve, and a fourth flow control valve. The wellhead assembly can also include piping coupled to the plurality of flow control valves. The wellhead assembly can further include a tubing hanger that is coupled to and suspends a tubing string. The wellhead assembly can also include a tubing spool that includes a body having a body cavity, a first channel, and a second channel disposed therein, where the tubing hanger is positioned within the body cavity of the body, where the first channel is in communication with a tubing string cavity of the tubing string, where the second channel is in communication with an annulus located between the tubing string and a production casing, where the first channel and the second channel are coupled to the piping, and where the first channel and the second channel are each configured to facilitate flow of at least one of a plurality of fluids in either direction independently of each other. The tubing spool of the wellhead assembly can also include a first back pressure valve disposed within the first channel to isolate the first channel. The tubing spool of the wellhead assembly can further include a second back pressure valve disposed within the second channel to isolate the second channel. The first flow control valve and the second flow control valve can control flow relative to the first channel, and the third flow control valve and the fourth flow control valve can control flow relative to the second channel.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DESCRIPTION OF THE INVENTION

Figure 1:
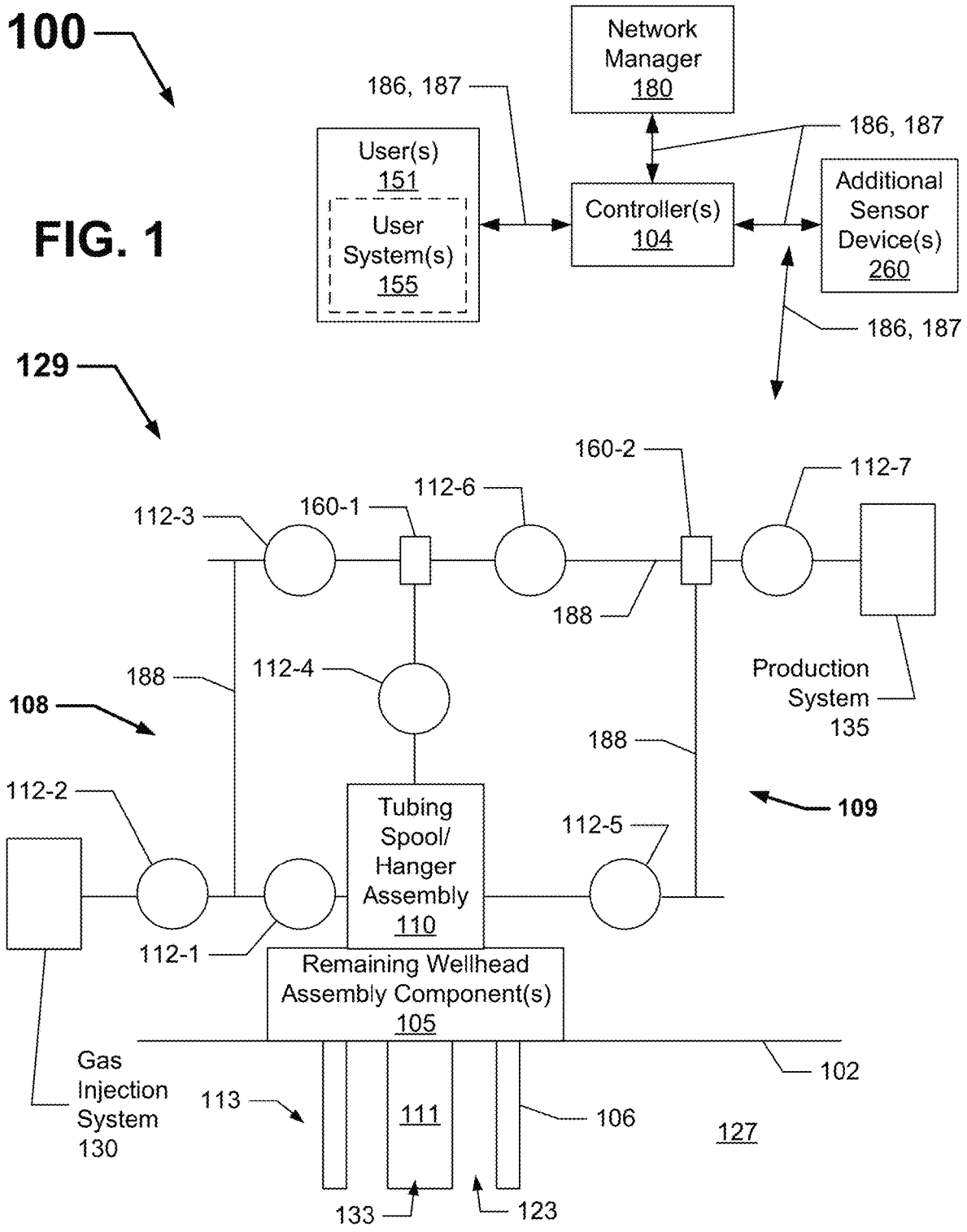
FIG. 1 shows a system that includes a wellhead assembly according to certain example embodiments.

The example embodiments discussed herein are directed to systems, apparatus, methods, and devices for independent control and operations of the tubing and annulus at the wellhead. Example embodiments can be used in wellhead assemblies for subterranean field operations (e.g., injection operations, production operations). Example embodiments are configured to safely allow for the independent control and subterranean field operations through the tubing and the annulus between the tubing and the production casing at the wellhead assembly. Example embodiments can be used for wellhead assemblies in both land-based and offshore subterranean operations. While example embodiments are described as being used in conjunction with tubing spools herein, example embodiments can be used, in full or in part, in conjunction with other components of a wellhead assembly.

A wellhead assembly that includes example embodiments can include one or multiple components, where a component can be made from a single piece (as from a mold or an extrusion or a three-dimensional printing process). When a component (or portion thereof) of a wellhead assembly that includes example embodiments is made from a single piece, the single piece can be cut out, bent, stamped, and/or otherwise shaped to create certain features, elements, or other portions of the component. Alternatively, a component (or portion thereof) of a wellhead assembly that includes example embodiments can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, rotatably, removably, slidably, and threadably.

Wellhead assemblies that use example embodiments can be designed to comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Each component of a wellhead assembly (including portions thereof) can be made of one or more of a number of suitable materials, including but not limited to metal (e.g., stainless steel), ceramic, rubber, glass, fibrous material, and plastic.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of independent control and operations of the tubing and annulus at the wellhead will be described more fully hereinafter with reference to the accompanying drawings, in which example embodiments of independent control and operations of the tubing and annulus at the wellhead are shown. Independent control and operations of the tubing and annulus at the wellhead may, however, be embodied in many different forms and should not be construed as limited to the example embodiments set forth herein. Rather, these example embodiments are provided so that this disclosure will be thorough and complete, and will fully convey the scope of independent control and operations of the tubing and annulus at the wellhead to those of ordinary skill in the art. Like, but not necessarily the same, elements (also sometimes called components) in the various figures are denoted by like reference numerals for consistency.

Terms such as "first", "second", "outer", "inner", "top", "bottom", "above", "below", "distal", "proximal", "front,", "rear," "left," "right," "on", and "within", when present, are used merely to distinguish one component (or part of a component or state of a component) from another. This list of terms is not exclusive. Such terms are not meant to denote a preference or a particular orientation, and they are not meant to limit embodiments of independent control and operations of the tubing and annulus at the wellhead. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a system 100 that includes a wellhead assembly 129 according to certain example embodiments. In this case, in addition to the wellhead assembly 129, the system 100 includes one or more users 151 (which can each include one or more user systems 155), one or more controllers 104, a network manager 180, one or more additional sensor devices 260, a gas injection system 130, a production system 135, and a wellbore 113 in a subterranean formation 127. The wellhead assembly 129 of the system 100 can include multiple valves 112 (e.g., valve 112-1, valve 112-2), multiple sensor devices 160 (e.g., sensor device 160-1, sensor device 160-2), piping 188, the tubing spool/hanger assembly 110, and one or more remaining wellhead assembly components 105. The tubing spool/hanger assembly 110 includes a tubing hanger housed within a tubing spool. An example of a tubing spool/hanger assembly 110 is shown in more detail below with respect to FIGS. 2 and 3. The wellbore 113 has a production casing 106, inside of which is positioned a tubing string 111 (sometimes referred to herein as tubing 111). The tubing string 111 has a cavity 133 that extends continuously along its length, and there is an annulus 123 between the tubing string 111 and the production casing 106 that extends continuously along its length.

The components shown in FIG. 1 are not exhaustive, and in some embodiments, one or more of the components shown in FIG. 1 may not be included in a wellhead assembly in which the example tubing spool/hanger assembly 110 can be used. Any component of the wellhead assembly 129 can be discrete or combined with one or more other components of the wellhead assembly 129. Also, one or more components of the wellhead assembly 129 can have different configurations.

The tubing spool/hanger assembly 110 of the wellhead assembly 129 is configured to support the tubing string 111. Generally, the tubing spool 110 is positioned toward the top of the wellhead assembly 129. The tubing spool 110 can have any of a number of configurations (e.g., mating threads, recesses) and/or components (e.g., pins) to support the tubing string 111 while also incorporating a sealing system to ensure that the cavity 133 within the tubing string 111 and the annulus 123 between the tubing string 111 and the production casing 106 are hydraulically isolated from each other. Once the wellbore 113 is drilled, the production casing 106 is inserted into the wellbore 113 to stabilize the wellbore 113 and allow for the extraction of subterranean resources (e.g., natural gas, oil) from the subterranean formation 127. The production casing 106 is often secured to the subterranean formation 127 using cement in an intermediate field operation.

The tubing spool/hanger assembly 110 can be coupled, directly or indirectly, to one or more remaining wellhead assembly components 105. Examples of such remaining wellhead assembly components 105 can include, but are not limited to, a tubing head, and a casing hanger. At least one component (e.g., a remaining wellhead assembly component 105) of the wellhead assembly 129 can be positioned at the surface 102. Below the surface 102 is the subterranean formation 127. Within the subterranean formation 127 is one or more (in this case, one) wellbores 113. In some cases, the surface 102 is under water (e.g., a seabed). In such cases, the wellhead assembly 129 can be located in the water.

The tubing spool/hanger assembly 110 can also be coupled directly to piping 188. The piping 188 can include multiple pipes, ducts, elbows, joints, sleeves, collars, and similar components that are coupled to each other (e.g., using coupling features such as mating threads) to establish a network for transporting one or more fluids (e.g., an injection gas, a production fluid) at different times. Each component of the piping 188 can have an appropriate size (e.g., inner diameter, outer diameter) and be made of an appropriate material (e.g., steel, PVC) to safely and efficiently handle the pressure, temperature, flow rate, acidity, and other characteristics of the fluids that can flow therethrough.

Each of the valves 112 (also sometimes referred to a flow control valves 112 herein) can be placed in-line with the piping 188 at various locations in the wellhead assembly 129 of the system 100 to control the flow of one or more fluids at a given point in time. A valve 112 can have one or more of any of a number of configurations, including but not limited to a guillotine valve, a ball valve, a gate valve, a butterfly valve, a pinch valve, a needle valve, a plug valve, a diaphragm valve, and a globe valve. One valve 112 can be configured the same as or differently compared to another valve 112 in the wellhead assembly 129 of the system 100. Also, one valve 112 can be controlled (e.g., manually, automatically by the controller 104) the same as or differently compared to another valve 112 in the wellhead assembly 129 of the system 100.

As discussed above, the wellhead assembly 129 of the system 100 can include one or more valves 112. For example, in this case, the wellhead assembly 129 includes 7 valves 112 (valve 112-1, valve 112-2, valve 112-3, valve 112-4, valve 112-5, valve 112-6, and valve 112-7). Each valve 112 has a fully open position that allows a fluid to flow uninhibited therethrough and a fully closed position that prevents any fluid from flowing therethrough. In some cases, a valve 112 can also have any of a number of other positions (half open, a quarter closed, a quarter open) between fully open and fully closed that inhibit some amount of fluid flowing therethrough. Such other positions of a valve 112 can be discrete or continuous.

One end of valve 112-1 is coupled to piping 188 that is directly coupled to the side end 139-2 of the channel 134 of the tubing spool/hanger assembly 110. The other end of valve 112-1 is coupled to piping 188 that is directly coupled to one end of valve 112-2 and to one end of valve 112-3. The other end of valve 112-2 is coupled to piping 188 that is directly coupled to the gas injection system 130. The other end of valve 112-3 is coupled to piping 188 that is directly coupled to one end of valve 112-4 and to one end of valve 112-6. The other end of valve 112-4 is coupled to piping 188 that is directly coupled to the top end of channel 124 of the tubing spool/hanger assembly 110.

The other end of valve 112-6 is coupled to piping 188 that is directly coupled to one end of valve 112-7 and to one end of valve 112-5. The other end of valve 112-5 is coupled to piping 188 that is directly coupled to piping 188 that is directly coupled to the side end 139-1 of the channel 134 of the tubing spool/hanger assembly 110. The other end of valve 112-7 is coupled to piping 188 that is directly coupled to the gas injection system 135. In alternative embodiments, the wellhead assembly 129 can have additional valves 112 (e.g., two valves 112 in series instead of a single valve 112), a different piping configuration, a different number of sensor devices 160, a different location of the sensor devices 160, etc.

In certain example embodiments, the wellhead assembly 129 includes one or more sensor devices 160. Each sensor device 160 includes one or more sensors that measure one or more parameters (e.g., pressure, flow rate, temperature, fluid content, permeability, voltage, current, porosity, rock characteristics, chemical elements in a fluid, chemical elements in a solid). Examples of a sensor of a sensor device 160 can include, but are not limited to, a temperature sensor, a flow sensor, a pressure sensor (e.g., a pressure transducer), a gas spectrometer, a voltmeter, an ammeter, a permeability meter, a porosimeter, and a camera.

A sensor device 160 can be configured to measure one or more parameters of a fluid flowing through that part of the wellhead assembly 129. For example, a sensor device 160 can be configured to measure a parameter (e.g., flow rate, pressure, temperature) of a fluid flowing through the piping 188 at a particular location (e.g., between valve 112-3, valve 112-4, and valve 112-6) in the wellhead assembly 129. In this example, the wellhead assembly 129 includes two sensor devices 160. Sensor device 160-1 is located between valve 112-3, valve 112-4, and valve 112-6. Sensor device 160-2 is located between valve 112-5, valve 112-6, and valve 112-7. In some cases, a sensor device 160 can be configured to determine how open or closed a valve 112 within the wellhead assembly 129 is.

The gas injection system 130 of the system 100 is configured to provide injection gas to the wellhead assembly 129 for injection into the wellbore 113. Injecting gas into the wellbore 113 can increase pressure within the subterranean formation 127, which can enhance recovery of a subterranean resource (e.g., oil, natural gas) from the subterranean formation 127. The gas injection system 130 can include one or more of any of a number of pieces of equipment. Examples of such equipment can include, but is not limited to, a motor, a pump, a compressor, a controller (similar to a controller 104), a sensor device 160, piping (similar to piping 188), a valve (similar to a valve 112), a storage tank, a gasket, and a mixing apparatus. Some or all of the gas injection system 130 can be located at or near the surface 102 and/or above the surface 102. Also, some or all of the gas injection system 130 can be located proximate to the wellhead assembly 129 and/or away from the wellhead assembly 129.

The production system 135 of the system 100 is configured to collect and extract one or more production fluids (e.g., water, a subterranean resource) from the subterranean formation 127 through the wellbore 113. The production system 135 can include one or more of any of a number of pieces of equipment. Examples of such equipment can include, but is not limited to, a motor, a pump, a compressor, a controller (similar to a controller 104), a sensor device 160, piping (e.g., similar to piping 188, a pipeline), a valve (similar to a valve 112), a collection tank, a gasket, and a mixing apparatus. Some or all of the production system 135 can be located at or near the surface 102 and/or above the surface 102. Also, some or all of the production system 135 can be located proximate to the wellhead assembly 129 and/or away from the wellhead assembly 129.

As stated above, the system 100 can include one or more controllers 104. A controller 104 of the system 100 communicates with and in some cases controls one or more of the other components (e.g., a sensor device 160, an additional sensory device 260, the gas injection system 130, the production system 135) of the system 100. A controller 104 performs a number of functions that include obtaining and sending data, evaluating data, following protocols, running algorithms, and sending commands. A controller 104 can include one or more of a number of components. Such components of a controller 104 can include, but are not limited to, a control engine, a communication module, a timer, a counter, a power module, a storage repository, a hardware processor, memory, a transceiver, an application interface, and a security module. When there are multiple controllers 104 (e.g., one controller 104 for the gas injection system 130, another controller 104 for the production system 135, yet another controller 104 for sensor device 160-1), each controller 104 can operate independently of each other. Alternatively, one or more of the controllers 104 can work cooperatively with each other. As yet another alternative, one of the controllers 104 can control some or all of one or more other controllers 104 in the system 100.

Each sensor device 260 can be substantially the same as the sensor devices 160 discussed above that are integrated with the wellhead assembly 129. For example, each sensor device 260 can include one or more sensors that measure one or more parameters (e.g., pressure, flow rate, temperature, humidity, fluid content, voltage, current, permeability, porosity, rock characteristics, chemical elements in a fluid, chemical elements in a solid). Examples of a sensor of a sensor device 260 can include, but are not limited to, a temperature sensor, a flow sensor, a pressure sensor, a gas spectrometer, a voltmeter, an ammeter, a permeability meter, a porosimeter, and a camera. A sensor device 260 can be integrated with or measure a parameter associated with one or more components of the system 100. For example, a sensor device 260 can be configured to measure a parameter (e.g., flow rate, pressure, temperature, gas composition) of a gas used in the gas injection system 130.

In some cases, a number of sensor devices (e.g., sensor devices 160, sensor devices 260), each measuring a different parameter and/or the same parameter at different locations in the system 100, can be used in combination to determine and confirm whether a controller 104 should take a particular action (e.g., operate a valve 112, operate or adjust the operation of the production system 135). In some cases, a sensor device (e.g., sensor device 160, sensor device 260) includes its own controller 104 (or portions thereof).

A user 151 can be any person that interacts, directly or indirectly, with a controller 104 and/or any other component of the system 100. Examples of a user 151 can include, but are not limited to, a business owner, an engineer, a company representative, a geologist, a consultant, a drilling engineer, a contractor, and a manufacturer's representative. A user 151 can use one or more user systems 155, which may include a display (e.g., a GUI). A user system 155 of a user 151 can interact with (e.g., send data to, obtain data from) a controller 104 via an application interface and using the communication links 186. The user 151 can also interact directly with a controller 104 through a user interface (e.g., keyboard, mouse, touchscreen).

The network manager 180 is a device or component that controls all or a portion (e.g., a communication network, a controller 104) of the system 100. The network manager 180 can be substantially similar to a controller 104, as described above. For example, the network manager 180 can include a controller that has one or more components and/or similar functionality to some or all of a controller 104. Alternatively, the network manager 180 can include one or more of a number of features in addition to, or altered from, the features of a controller 104. As described herein, control and/or communication with the network manager 180 can include communicating with one or more other components of the same system 100 or another system. In such a case, the network manager 180 can facilitate such control and/or communication. The network manager 180 can be called by other names, including but not limited to a master controller, a network controller, and an enterprise manager.

Interaction between each controller 104, the sensor devices (sensor devices 160, sensor devices 260), the users 151 (including any associated user systems 155), the network manager 180, and other components (e.g., the valves 112, the gas injection system 130, the production system 135) of the system 100 can be conducted using communication links 186 and/or power transfer links 187. Each communication link 186 can include wired (e.g., Class 1 electrical cables, Class 2 electrical cables, electrical connectors, Power Line Carrier, RS485) and/or wireless (e.g., Wi-Fi, Zigbee, visible light communication, wave energy, pulse energy, cellular networking, Bluetooth, Bluetooth Low Energy (BLE), ultrawide band (UWB), WirelessHART, ISA100) technology. A communication link 186 can transmit signals (e.g., communication signals, control signals, data) between each controller 104, the sensor devices (sensor devices 160, sensor devices 260), the users 151 (including any associated user systems 155), the network manager 180, and the other components of the system 100.

Each power transfer link 187 can include one or more electrical conductors, which can be individual or part of one or more electrical cables. In some cases, as with inductive power, power can be transferred wirelessly using power transfer links 187. A power transfer link 187 can transmit power between each controller 104, the sensor devices (sensor devices 160, sensor devices 260), the users 151 (including any associated user systems 155), the network manager 180, and the other components of the system 100. Each power transfer link 187 can be sized (e.g., 12 gauge, 18 gauge, 4 gauge) in a manner suitable for the amount (e.g., 480V, 24V, 120V) and type (e.g., alternating current, direct current) of power transferred therethrough.

Figure 2:
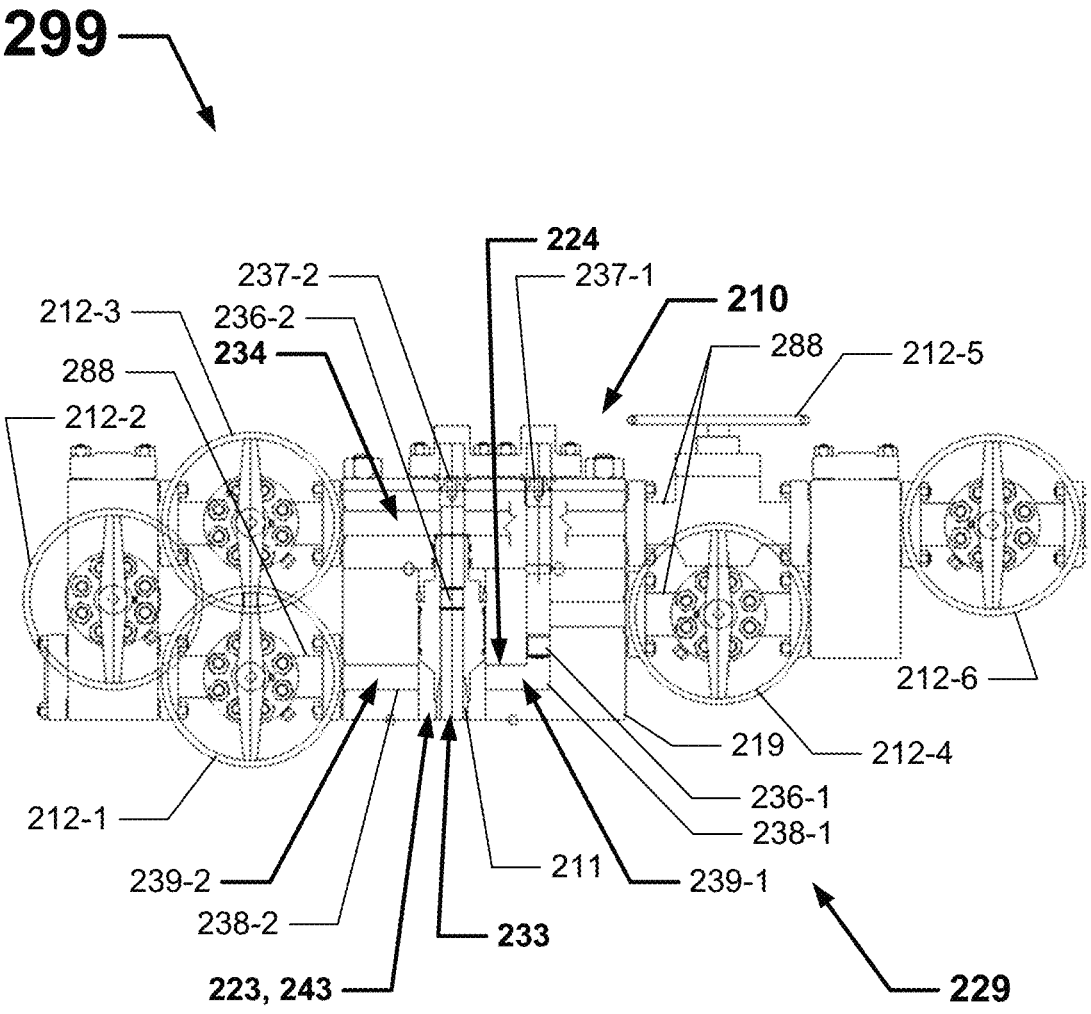
FIG. 2 shows a sectional view of a subassembly that includes a tubing spool/hanger assembly 210 according to certain example embodiments.
Figure 3:
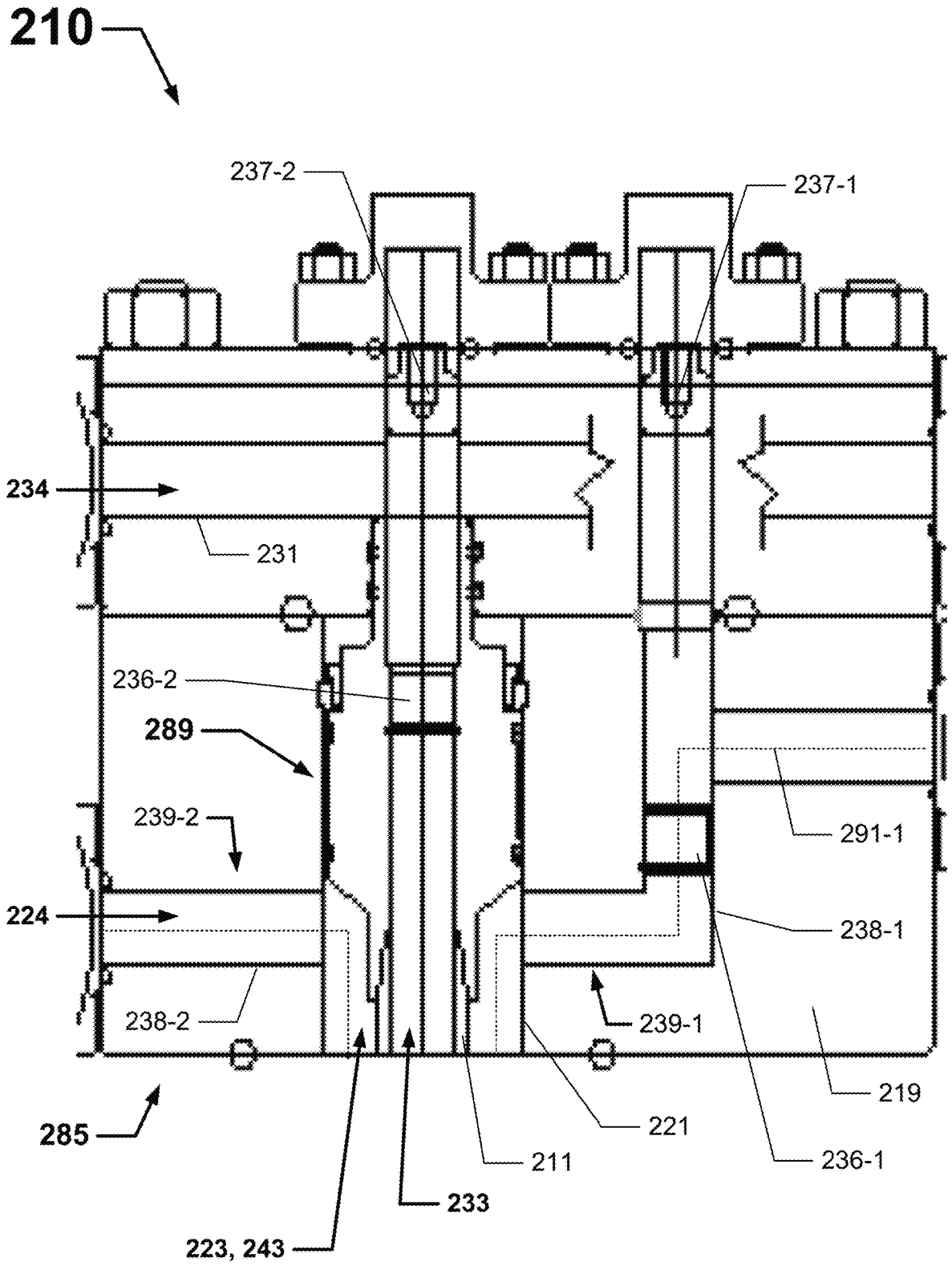
FIG. 3 shows a detailed sectional view of the tubing spool/hanger assembly of FIG. 2.

FIG. 2 shows a sectional view of a subassembly 299 that includes a tubing spool/hanger assembly 210 according to certain example embodiments. FIG. 3 shows a detailed sectional view of the tubing spool/hanger assembly 210 of FIG. 2. Referring to FIGS. 1 through 3, the subassembly 299 includes a wellhead assembly 229 that includes the tubing spool/hanger 210, the top part of a tubing string 211, piping 288, and six valves 212 (valve 212-1, valve 212-2, valve 212-3, valve 212-4, valve 212-5 and valve 212-6). The tubing spool/hanger assembly 210 includes a tubing spool 285 and a tubing hanger 289. The wellhead assembly 229, the tubing spool/hanger assembly 210, the tubing string 211, and the valves 212 (also sometimes referred to as flow control valves 212 herein) of FIG. 3 can be substantially the same as the wellhead assembly 129, the tubing spool/hanger assembly 110, the tubing string 111, the piping 188, and the valves 112 discussed above with respect to FIG. 1, except as described below.

In this case, the tubing spool/hanger assembly 210 is part of the wellhead assembly 229. The tubing hanger 289 of the tubing spool/hanger assembly 210 is substantially the same as tubing hangers currently known in the art. The tubing hanger 289 is configured to be positioned within a cavity 243 disposed in the bottom middle of the body 219 of the example tubing spool 285. The cavity 243 of the tubing spool 285 is defined by a wall 221 of the body 219. The tubing hanger 289 couples to and supports the tubing string 211. The tubing hanger 289 has a cavity 233 that runs continuously through the tubing hanger 289 along the height of the tubing hanger 289. The cavity 233 has a diameter that is substantially the same as the inner diameter of the tubing string 211. The top end of the cavity 233 of the tubing hanger 289 is configured to be in communication with a channel 224 disposed in the body 219 of the example tubing spool 285.

The example tubing spool 285 of the tubing spool/hanger assembly 210 has a body 219 with two channels (channel 234 and channel 224) and the cavity 243 disposed therein. Channel 234 within the body 219 of the tubing spool 285 intersects with the top end of the tubing hanger 289 and the cavity 233 that traverses therethrough. The channel 234 is substantially horizontal and crosses through the body 219 near the top end of the tubing spool 285. The channel 234 is defined by one or more walls 231 in the body 219. The channel 234 is substantially cylindrical in shape along its length, and so there is one wall 231 that defines the channel 234.

In alternative embodiments, the channel 234 can have one or more different characteristics compared to what is shown and described in FIGS. 2 and 3. For example, the channel 234 can have one or more cross-sectional shapes along its length in alternative embodiments. As another example, some or all of the channel 234 can have an orientation other than horizontal. As yet another example, the channel 234 can have one or more bends or curves. As still another example, the diameter of the channel 234 can vary along its length.

The channel 224 in the body 219 of the example tubing spool 285 of FIGS. 2 and 3 is located toward the bottom end of the tubing spool 285. The channel 224 in this case includes two side ends 239. One side end 239-1 (defined by a wall 238-1 in the body 219) extends from one side of the cavity 243 (which also forms the top end of the annulus 223). Flow path 291-1 shows the path through the side end 239-1 of the channel 224 that a fluid can flow. In this case, the side end 239-1 of the channel 224 has a horizontal section adjacent to the cavity 243. At the distal end of this horizontal section is a vertical section that extends upward toward the top of the tubing spool 285. Along the length of this vertical section (in this case, about ⅓ up the length of the vertical section), another horizontal section extends to the outer perimeter of the tubing spool 285. The two horizontal sections and the vertical section can be substantially planar with respect to each other.

The other side end 239-2 (defined by a wall 238-2 in the body 219) extends from the opposite side of the cavity 243. In this case, the side end 239-2 is a single substantially horizontal section. The side end 239-2 of the channel 224 can be planar with the side end 239-1 of the channel 224. In some cases, the characteristics (e.g., cross-sectional shape, diameter) of the channel 224 (e.g., all of the side end 239-1 and all of the side end 239-2) can be substantially the same throughout the channel 224. In alternative embodiments, one or more characteristics of the channel 224 can vary along the length of the channel 224.

The channel 224 and the channel 234, including portions thereof, can have any of a number of configurations (e.g., cross-sectional shape, path, size) suitable to transport fluids therethrough. Part of the channel 234 runs in parallel with the channel 224 within the body 219 of the tubing spool 285, but at least part of the channel 234 may need to detour around one or more other portions (e.g., the top portion, one of the side ends 239) of the channel 224, or vice-versa. In some cases, the channel 224 and/or the channel 234 can be an aggregate of multiple channels that meet at the top, bottom, and/or side of the body 219 of the tubing spool 285.

In this example, valve 212-1 of the wellhead assembly 229 of FIG. 2 can be substantially the same as valve 112-1 of the wellhead assembly 129 of FIG. 1. Valve 212-2 of the wellhead assembly 229 of FIG. 2 can be substantially the same as valve 112-2 of the wellhead assembly 129 of FIG. 1. Valve 212-3 of the wellhead assembly 229 of FIG. 2 can be substantially the same as valve 112-3 of the wellhead assembly 129 of FIG. 1. Valve 212-4 of the wellhead assembly 229 of FIG. 2 can be substantially the same as valve 112-5 of the wellhead assembly 129 of FIG. 1. Valve 212-5 of the wellhead assembly 229 of FIG. 2 can be substantially the same as valve 112-6 of the wellhead assembly 129 of FIG. 1. Valve 212-6 of the wellhead assembly 229 of FIG. 2 can be substantially the same as valve 112-7 of the wellhead assembly 129 of FIG. 1. The wellhead assembly 229 of FIG. 2 does not include an equivalent of valve 112-4 of the wellhead assembly 129 of FIG. 1.

The side end 239-2 of the channel 224 is directly coupled to piping 288 and valve 212-1, which are in communication (through valve 212-2) with a gas injection system (e.g., gas injection system 130) and the injection portion (e.g., injection portion 108) of the wellhead assembly 229. In this case, the side end 239-2 of the channel 224 is configured to receive a gas from the gas injection system. The side end 239-1 of the channel 224 is directly coupled to piping 288 and valve 212-4, which are in communication (along with valve 212-6) with a production system (e.g., production system 135) and the production portion (e.g., production portion 109) of the wellhead assembly 229. In this case, the side end 239-1 of the channel 224 is configured to direct a production fluid (e.g., oil, gas, water) to the production system.

Positioned within the side end 239-1 of the channel 224 is a bypass valve 236-1 (BPV 236-1). Specifically, the BPV 236-1 is positioned within the vertical section of the side end 239-1 of the channel 224, between the two horizontal sections of the side end 239-1. The BPV 236-1 can act as a check valve to isolate the channel 224. In alternative embodiments, there can be more than on BPV in the channel 224. Positioned above the BPV 236-1 in the vertical section of the side end 239-1 of the channel 224, above both horizontal sections of the side end 239-1, is a barrier 237-1. The barrier 237-1 (e.g., a crown plug) can be configured to isolate the channel 224 in terms of pressure, fluid flow or leakage, temperature, and/or any other suitable factor that can affect the operations within the annulus 223.

Positioned within the cavity 233 of the tubing hanger 289, below the channel 234, is a BPV 236-2 (substantially similar to the BPV 236-1 discussed above). In this case, the BPV 236-2 is vertically oriented within the cavity 233 of the tubing hanger 289. The BPV 236-1 can be configured the same as, or differently than, the BPV 236-2. Positioned above the BPV 236-2 in the cavity 233 of the tubing hanger 289 is a barrier 237-2, which can be substantially similar to the barrier 237-1 discussed above. The barrier 237-2 (e.g., a crown plug) can be configured to isolate the channel 234 in terms of pressure, fluid flow or leakage, temperature, and/or any other suitable factor that can affect the operations within the cavity 233 of the tubing hanger 289 and the tubing string 211.

Because of the configuration of channel 224 and channel 234 within the body 219 of the tubing spool 285 and their isolation from each other, channel 224 and channel 234 are each configured to facilitate flow of at least one fluid in either direction independently of each other. In this way, at a point in time, channel 224 can be isolated, configured for gas injection, or configured for fluid production, and simultaneously and independent of the configuration of channel 224, channel 234 can be isolated, configured for gas injection, or configured for fluid production.

Figure 4:
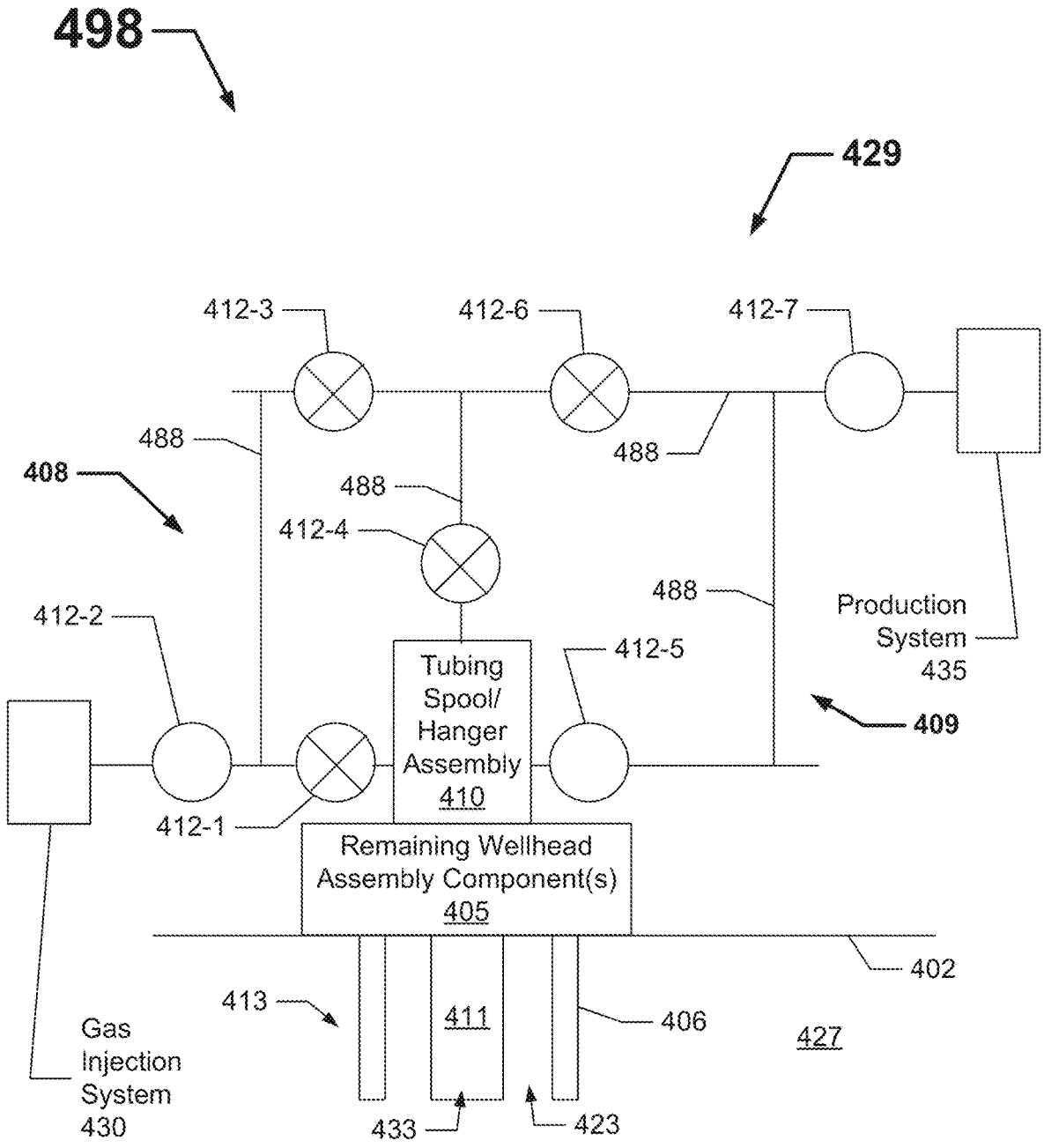
FIG. 4 shows a subsystem that includes a wellhead assembly in an operational configuration according to certain example embodiments.
Figure 5:
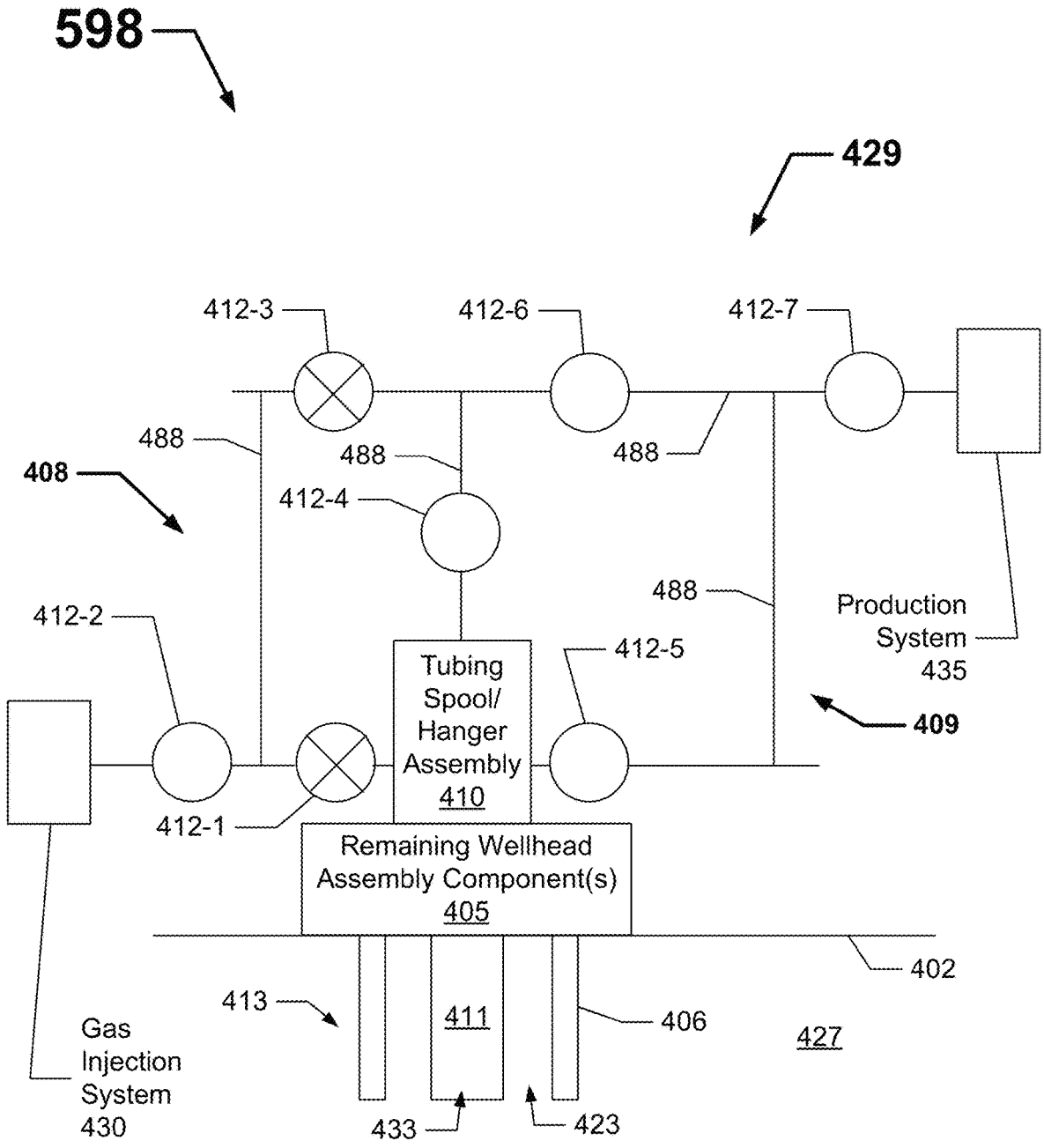
FIG. 5 shows a subsystem that includes the wellhead assembly of FIG. 4 in another operational configuration according to certain example embodiments.
Figure 6:
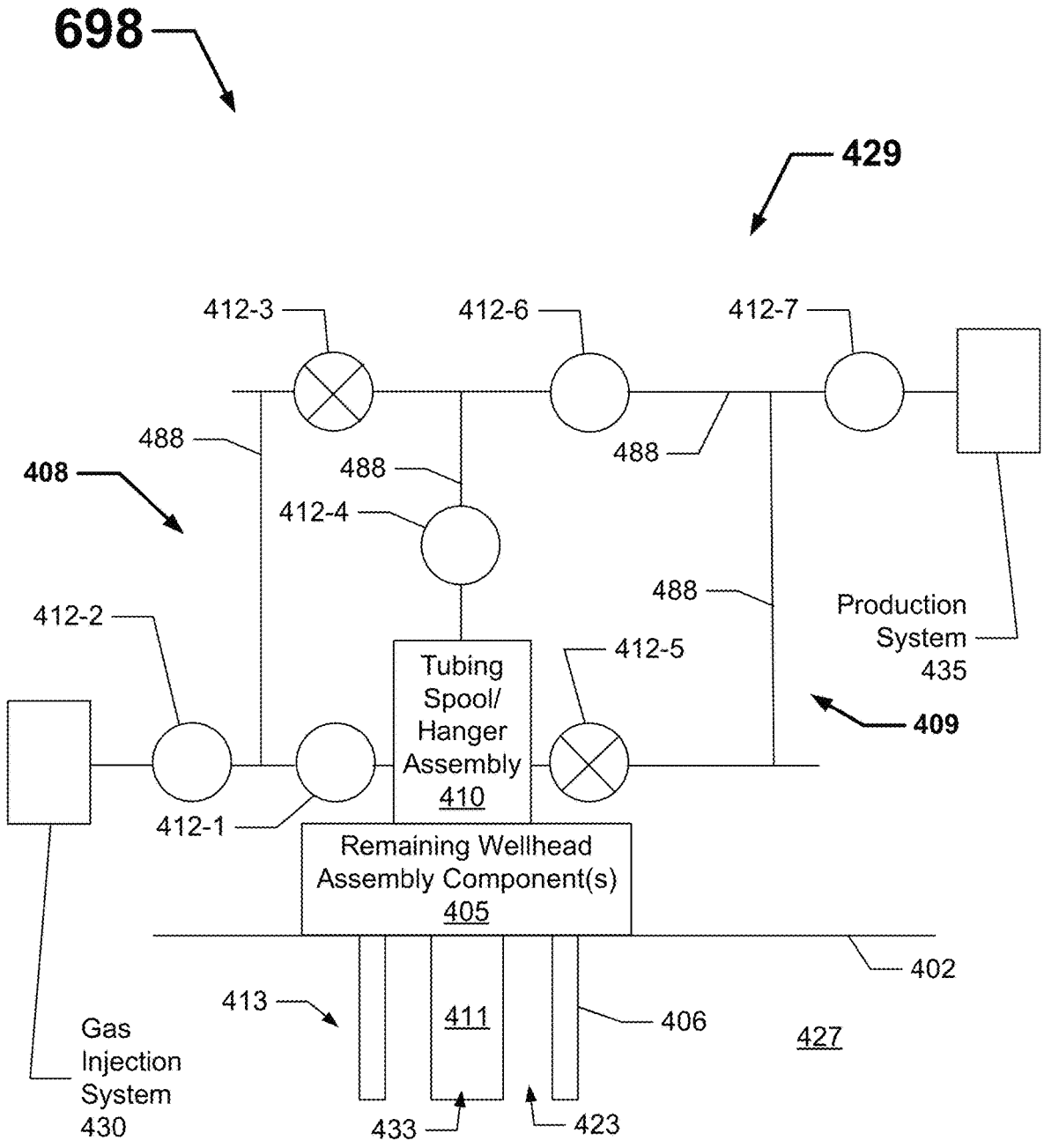
FIG. 6 shows a subsystem that includes the wellhead assembly of FIG. 4 in yet another operational configuration according to certain example embodiments.
Figure 7:
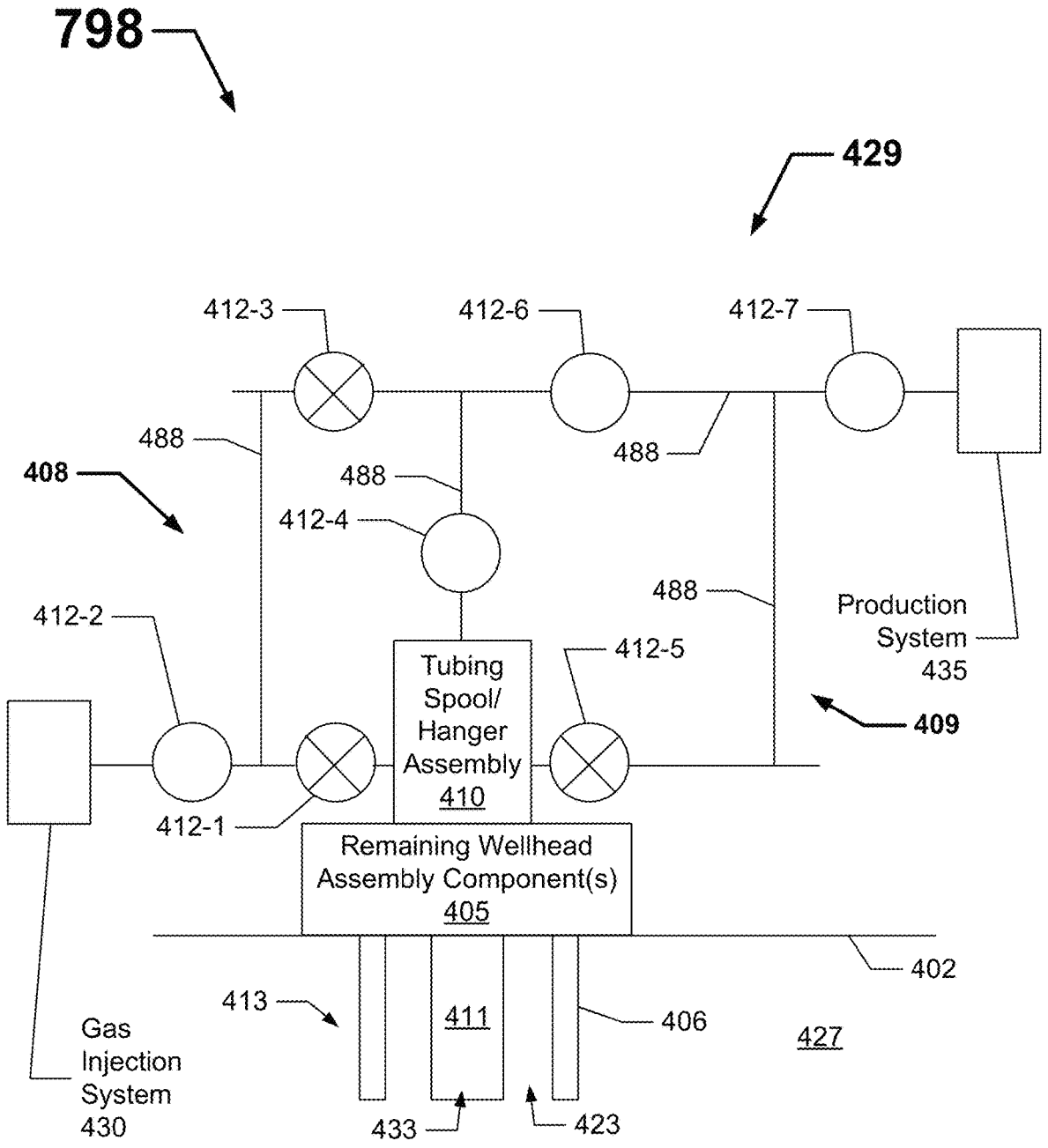
FIG. 7 shows a subsystem that includes the wellhead assembly of FIG. 4 in still another operational configuration according to certain example embodiments.
Figure 8:
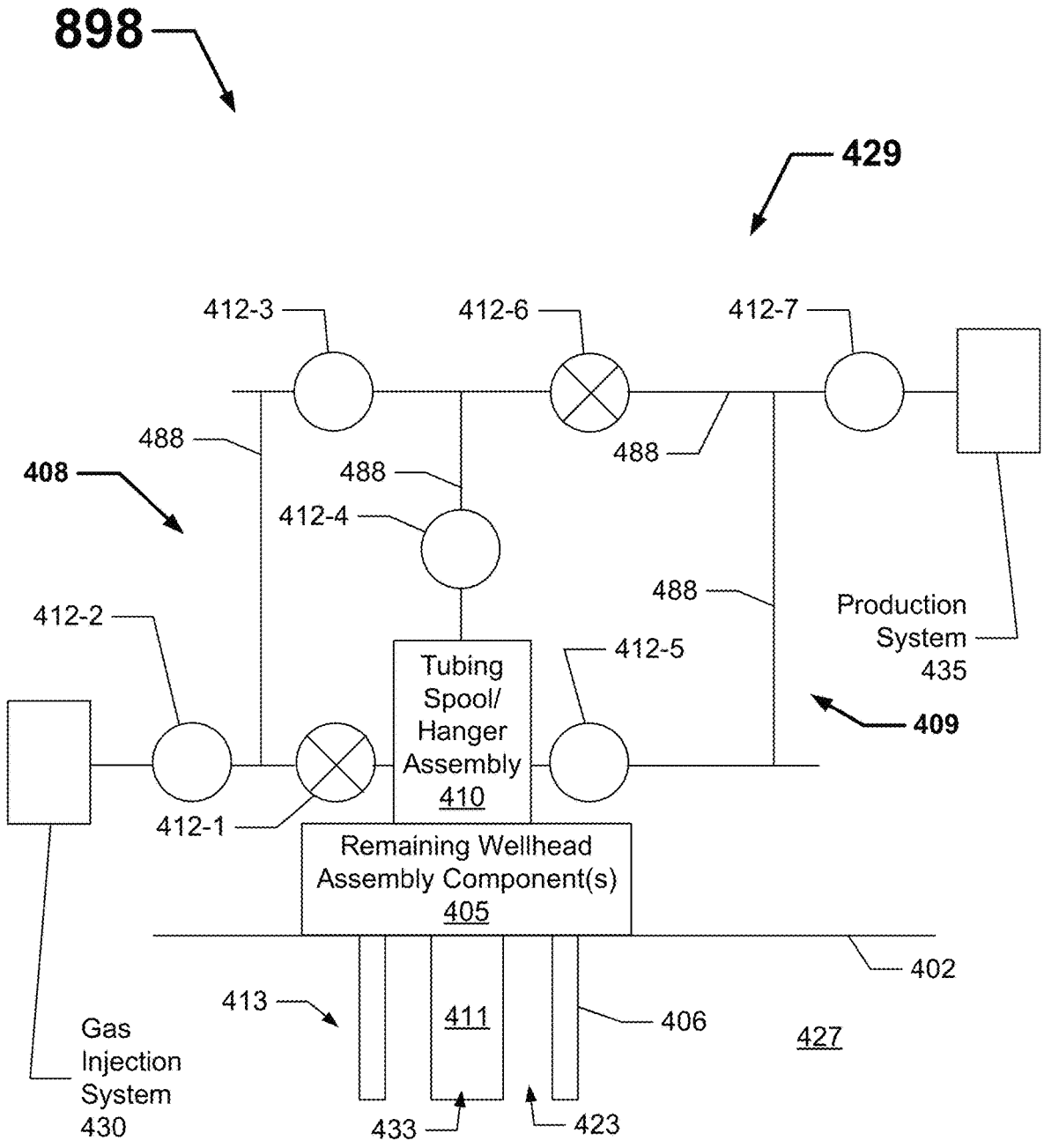
FIG. 8 shows a subsystem that includes the wellhead assembly of FIG. 4 in yet another operational configuration according to certain example embodiments.

FIG. 4 shows a subsystem 498 that includes a wellhead assembly 429 in an operational configuration according to certain example embodiments. FIG. 5 shows a subsystem 598 that includes the wellhead assembly 429 of FIG. 4 in another operational configuration according to certain example embodiments. FIG. 6 shows a subsystem 698 that includes the wellhead assembly 429 of FIG. 4 in yet another operational configuration according to certain example embodiments. FIG. 7 shows a subsystem 798 that includes the wellhead assembly 429 of FIG. 4 in still another operational configuration according to certain example embodiments. FIG. 8 shows a subsystem 898 that includes the wellhead assembly 429 of FIG. 4 in yet another operational configuration according to certain example embodiments.

Referring to FIGS. 1 through 8, the subsystem 498 of FIG. 4, the subsystem 598 of FIG. 5, the subsystem 698 of FIG. 6, the subsystem 798 of FIG. 7, and the subsystem 898 of FIG. 8 include the wellhead assembly 429, a gas injection system 430, a production system 435, a wellbore 413 drilled into the subterranean formation 427 below the surface 402, a production casing 406 at the outer perimeter of the wellbore 413, and a tubing string 411 disposed within the production casing 406. The tubing string 411 has a cavity 433 that runs along its length, and there is an annulus 423 between the tubing string 411 and the production casing 406. The wellhead assembly 429 includes seven valves 412 (valve 412-1, valve 412-2, valve 412-3, valve 412-4, valve 412-5, valve 412-6, and valve 412-7), a tubing spool/hanger assembly 410, one or more remaining wellhead assembly components 405, and piping 488.

The various components of the subassembly 498 of FIG. 4 can be substantially similar to the corresponding components of the system 100 of FIG. 1 and the subassembly 299 of FIGS. 2 and 3. For example, the tubing spool/hanger assembly 410 of FIGS. 4 through 8 can include a tubing spool that is substantially similar to the example tubing spool 285 discussed above with respect to FIGS. 2 and 3. There are no sensor devices (substantially similar to the sensor devices 160 of FIG. 1) shown in FIGS. 4 through 8 to make the drawings easier to follow, but in the field the subsystems of FIGS. 4 through 8 can include one or more sensor devices. The valves 412 can sometimes be referred to as flow control valves 412 herein. In some cases, valve 412-4 can be omitted without adversely affecting the execution of the operational configurations shown in FIGS. 4 through 8.

In the subsystem 498 of FIG. 4, the wellhead assembly 429 is configured so that the annulus 423 is isolated and the tubing string 411 is simultaneously produced through the cavity 433 (also called producing the tubing at times herein). To accomplish this operational configuration, valve 412-1 is fully closed, valve 412-2 is fully open, valve 412-3 is fully closed, valve 412-4 is fully closed, valve 412-5 is fully open, valve 412-6 is fully closed, and valve 412-7 is fully open.

As a result of the above valve configurations for the wellhead assembly 429 of the subsystem 498 of FIG. 4, the gas injection system 430 and the injection portion 408 of the wellhead assembly 429 are inactive. As a result, the annulus 423 is isolated (not producing production fluid and not receiving injection fluid). At the same time, the production system 435 and the production portion 409 of the wellhead assembly 429 produces production fluids from the wellbore 413 through the cavity 433 of the tubing string 411, through the channel (similar to channel 134) and a side end (similar to side end 139-1) of the tubing spool/hanger assembly 410, through valve 412-5 and valve 412-7 (including associated piping 488) to the production system 435.

In the subsystem 598 of FIG. 5, the wellhead assembly 429 is configured so that both the annulus 423 and the tubing string 411, through the cavity 433, are simultaneously produced. To accomplish this operational configuration, valve 412-1 is fully closed, valve 412-2 is fully open, valve 412-3 is fully closed, valve 412-4 is fully open, valve 412-5 is fully open, valve 412-6 is fully open, and valve 412-7 is fully open.

As a result of the above valve configurations for the wellhead assembly 429 of the subsystem 598 of FIG. 5, the gas injection system 430 and the injection portion 408 of the wellhead assembly 429 are inactive. The production system 435 and the production portion 409 of the wellhead assembly 429 produces production fluids from the wellbore 413 through the annulus 423, through the channel (similar to channel 124) of the tubing spool/hanger assembly 410, through valve 412-4, valve 412-6, and valve 412-7 (including associated piping 488) to the production system 435. At the same time, the production system 435 and the production portion 409 of the wellhead assembly 429 produces production fluids from the wellbore 413 through the cavity 433 of the tubing string 411, through the channel (similar to channel 134) and a side end (similar to side end 139-1) of the tubing spool/hanger assembly 410, through valve 412-5 and valve 412-7 (including associated piping 488) to the production system 435.

In the subsystem 698 of FIG. 6, the wellhead assembly 429 is configured so that injection fluid is injected into the cavity 433 of the tubing string 411 and, simultaneously, the annulus 423 is produced. To accomplish this operational configuration, valve 412-1 is fully open, valve 412-2 is fully open, valve 412-3 is fully closed, valve 412-4 is fully open, valve 412-5 is fully closed, valve 412-6 is fully open, and valve 412-7 is fully open.

As a result of the above valve configurations for the wellhead assembly 429 of the subsystem 698 of FIG. 6, the gas injection system 430 and the injection portion 408 of the wellhead assembly 429 are active. Specifically, the gas injection system 430 sends a fluid (e.g., an injection gas) to the injection portion 408 of the wellhead assembly 429 through valve 412-2 and valve 412-1 (including associated piping 488), through the channel (similar to channel 134) and a side end (similar to side end 139-2) of the tubing spool/hanger assembly 410, and through the cavity 433 of the tubing string 411. At the same time, the production system 435 and the production portion 409 of the wellhead assembly 429 produces production fluids from the wellbore 413 through the annulus 423, through the channel (similar to channel 124) of the tubing spool/hanger assembly 410, through valve 412-4, valve 412-6, and valve 412-7 (including associated piping 488) to the production system 435.

In the subsystem 798 of FIG. 7, the wellhead assembly 429 is configured so that the cavity 433 in the tubing string 411 is isolated and the annulus 423 is simultaneously produced. To accomplish this operational configuration, valve 412-1 is fully closed, valve 412-2 is fully open, valve 412-3 is fully closed, valve 412-4 is fully open, valve 412-5 is fully closed, valve 412-6 is fully open, and valve 412-7 is fully open.

As a result of the above valve configurations for the wellhead assembly 429 of the subsystem 798 of FIG. 7, the gas injection system 430 and the injection portion 408 of the wellhead assembly 429 are inactive. As a result, the cavity 433 of the tubing string 411 is isolated (not producing production fluid and not receiving injection fluid). At the same time, the production system 435 and the production portion 409 of the wellhead assembly 429 produces production fluids from the wellbore 413 through the annulus 423, through the channel (similar to channel 124) of the tubing spool/hanger assembly 410, through valve 412-4, valve 412-6, and valve 412-7 (including associated piping 488) to the production system 435.

In the subsystem 898 of FIG. 8, the wellhead assembly 429 is configured so that the annulus 423 is injected and the tubing string 411, through the cavity 433, is simultaneously produced. To accomplish this operational configuration, valve 412-1 is fully closed, valve 412-2 is fully open, valve 412-3 is fully open, valve 412-4 is fully open, valve 412-5 is fully open, valve 412-6 is fully closed, and valve 412-7 is fully open.

As a result of the above valve configurations for the wellhead assembly 429 of the subsystem 898 of FIG. 8, the gas injection system 430 and the injection portion 408 of the wellhead assembly 429 are active. Specifically, the gas injection system 430 sends a fluid (e.g., an injection gas) to the injection portion 408 of the wellhead assembly 429 through valve 412-2, valve 412-3, and valve 412-4 (including associated piping 488), through the channel (similar to channel 124) of the tubing spool/hanger assembly 410, and through the annulus 423. At the same time, the production system 435 and the production portion 409 of the wellhead assembly 429 produces production fluids from the wellbore 413 through the cavity 433 of the tubing string 411, through the channel (similar to channel 134) and a side end (similar to side end 139-2) of the tubing spool/hanger assembly 410, through valve 412-5 and valve 412-7 (including associated piping 488) to the production system 435.

Example embodiments can be used to independently configure and perform field operations (e.g., gas injection, production) with respect to the cavity of the tubing string and the annulus between the tubing string and the production casing. Example embodiments can include one or more BPVs to ensure safe operation by being able to isolate part of the wellbore. Example embodiments can be used with any of a number of field operations, including but not limited to a gas lift operation, removing water from a well ("rocking the well"), and a non-gas lift operation (e.g., for gas wells). Example embodiments can provide a number of benefits. Such other benefits can include, but are not limited to, ease of use, reduction in costs, reduced need of certain equipment traditionally used for gas injection and production, configurability, time savings, and compliance with applicable industry standards and regulations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method for operating a wellhead assembly, the method comprising:

installing the wellhead assembly at a wellbore, wherein the wellhead assembly comprises:

a plurality of flow control valves, wherein each of the plurality of flow control valves has a fully closed position and a fully open position, wherein the plurality of flow control valves comprises a first flow control valve, a second flow control valve, a third flow control valve, and a fourth flow control valve;

piping coupled to the plurality of flow control valves;

a tubing hanger that is coupled to and suspends a tubing string; and a tubing spool comprising:

a body having a body cavity, a first channel, and a second channel disposed therein, wherein the tubing hanger is positioned within the body cavity of the body, wherein the first channel is in communication with a tubing string cavity of the tubing string, wherein the second channel is in communication with an annulus located between the tubing string and a production casing, wherein the first channel and the second channel are coupled to the piping, and wherein the first channel and the second channel are each configured to facilitate flow of at least one of a plurality of fluids in either direction independently of each other;

a first back pressure valve disposed within the first channel in the body of the tubing spool to isolate the first channel within the body of the tubing spool; and a second back pressure valve disposed within the second channel in the body of the tubing spool to isolate the second channel within the body of the tubing spool, wherein each of the plurality of flow control valves is located outside the tubing spool, wherein the first flow control valve and the second flow control valve control flow relative to the first channel, and wherein the third flow control valve and the fourth flow control valve control flow relative to the second channel;

closing the first flow control valve and the third flow control valve;

opening the second flow control valve and the fourth flow control valve; and operating a production system in communication with the second flow control valve and the fourth flow control valve to produce the annulus and the tubing string.

2. The method of claim 1, further comprising, after operating the production system in communication with the second flow control valve and the fourth flow control valve to produce the annulus and the tubing string:

closing the second flow control valve while keeping the first flow control valve and the third flow control valve closed to isolate the annulus;

leaving the fourth flow control valve open; and operating the production system in communication with the fourth flow control valve to produce the tubing string.

3. The method of claim 1, further comprising, after operating the production system in communication with the second flow control valve and the fourth flow control valve to produce the annulus and the tubing string:

closing the second flow control valve while leaving the third flow control valve closed;

opening the first flow control valve while leaving the fourth flow control valve closed;

operating the production system in communication with the fourth flow control valve to produce the tubing string; and operating an injection system in communication with the first flow control valve to inject into the annulus.

4. The method of claim 1, wherein the flow relative to the first channel and the second channel occurs during a gas lift operation.

5. The method of claim 1, wherein the flow relative to the first channel and the second channel occurs during production of a gas well.

6. A method for operating a wellhead assembly, the method comprising:

installing the wellhead assembly at a wellbore, wherein the wellhead assembly comprises:

a plurality of flow control valves, wherein each of the plurality of flow control valves has a fully closed position and a fully open position, wherein the plurality of flow control valves comprises a first flow control valve, a second flow control valve, a third flow control valve, and a fourth flow control valve;

piping coupled to the plurality of flow control valves;

a tubing hanger that is coupled to and suspends a tubing string; and a tubing spool comprising:

a body having a body cavity, a first channel, and a second channel disposed therein, wherein the tubing hanger is positioned within the body cavity of the body, wherein the first channel is in communication with a tubing string cavity of the tubing string, wherein the second channel is in communication with an annulus located between the tubing string and a production casing, wherein the first channel and the second channel are coupled to the piping, and wherein the first channel and the second channel are each configured to facilitate flow of at least one of a plurality of fluids in either direction independently of each other;

a first back pressure valve disposed within the first channel in the body of the tubing spool to isolate the first channel within the body of the tubing spool; and a second back pressure valve disposed within the second channel in the body of the tubing spool to isolate the second channel within the body of the tubing spool, wherein each of the plurality of flow control valves is located outside the tubing spool, wherein the first flow control valve and the second flow control valve control flow relative to the first channel, and wherein the third flow control valve and the fourth flow control valve control flow relative to the second channel;

opening the second flow control valve and the third flow control valve;

closing the first flow control valve and the fourth flow control valve;

operating a production system in communication with the second flow control valve to produce the annulus; and operating an injection system in communication with the third flow control valve to inject into the tubing string.

7. A method for operating a wellhead assembly, the method comprising:

installing the wellhead assembly at a wellbore, wherein the wellhead assembly comprises:

a plurality of flow control valves, wherein each of the plurality of flow control valves has a fully closed position and a fully open position, wherein the plurality of flow control valves comprises a first flow control valve, a second flow control valve, a third flow control valve, and a fourth flow control valve;

piping coupled to the plurality of flow control valves;

a tubing hanger that is coupled to and suspends a tubing string; and a tubing spool comprising:

a body having a body cavity, a first channel, and a second channel disposed therein, wherein the tubing hanger is positioned within the body cavity of the body, wherein the first channel is in communication with a tubing string cavity of the tubing string, wherein the second channel is in communication with an annulus located between the tubing string and a production casing, wherein the first channel and the second channel are coupled to the piping, and wherein the first channel and the second channel are each configured to facilitate flow of at least one of a plurality of fluids in either direction independently of each other;

a first back pressure valve disposed within the first channel in the body of the tubing spool to isolate the first channel within the body of the tubing spool; and a second back pressure valve disposed within the second channel in the body of the tubing spool to isolate the second channel within the body of the tubing spool, wherein each of the plurality of flow control valves is located outside the tubing spool, wherein the first flow control valve and the second flow control valve control flow relative to the first channel, and wherein the third flow control valve and the fourth flow control valve control flow relative to the second channel;

closing the first flow control valve, the third flow control valve, and the fourth flow control valve to isolate the tubing string;

opening the second flow control valve; and operating a production system in communication with the second flow control valve to produce the annulus.

* * * * *